US006173473B1

(12) United States Patent
Miwa

(10) Patent No.: US 6,173,473 B1
(45) **Date of Patent: *Jan. 16, 2001**

(54) ELECTRIC CLEANER EFFICIENT FOR CARPET AND ITS HEAD

(75) Inventor: Hirohide Miwa, Kawasaki (JP)

(73) Assignee: Miwa Science Laboratory Inc., Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/950,795

(22) Filed: Oct. 15, 1997

(30) Foreign Application Priority Data

Jan. 20, 1997 (JP) ..... 9-19584

(51) Int. Cl.[7] ..... A47L 5/14

(52) U.S. Cl. ..... 15/345; 15/397; 15/402; 15/422.2

(58) Field of Search ..... 15/346, 397, 402, 15/345, 422.2

(56) References Cited

U.S. PATENT DOCUMENTS

| | | | | |
|---|---|---|---|---|
| 3,668,735 | * | 6/1972 | Dupea | 15/397 |
| 3,708,824 | * | 1/1973 | Holubinka | 15/397 |
| 3,745,604 | * | 7/1973 | Fitzwater | 15/397 |
| 3,771,193 | * | 11/1973 | Hageal | 15/397 |
| 3,816,872 | * | 6/1974 | Bayless et al. | 15/397 |
| 3,869,956 | * | 3/1975 | Melreit | 15/397 |
| 3,895,407 | * | 7/1975 | Parise | 15/397 |
| 3,992,748 | * | 11/1976 | Howard et al. | 15/397 |
| 4,045,840 | * | 9/1977 | Johansson | 15/397 |
| 4,580,309 | * | 4/1986 | Ogden | 15/422.2 |

FOREIGN PATENT DOCUMENTS

| | | | | |
|---|---|---|---|---|
| 2543477 | * | 4/1977 | (DE) | 15/346 |
| 50-155057 | | 12/1975 | (JP) . | |
| 51-95266 | | 7/1976 | (JP) . | |
| 54-138467 | | 9/1979 | (JP) . | |
| 54-158066 | | 12/1979 | (JP) . | |
| 55-153 | | 1/1980 | (JP) . | |
| 63-122415 | | 5/1988 | (JP) . | |
| 1-256920 | | 10/1989 | (JP) . | |

* cited by examiner

*Primary Examiner*—Mark Spisich
(74) *Attorney, Agent, or Firm*—Pollock, Vande Sande & Amernick

(57) ABSTRACT

An electric cleaner head including a first bank of a plurality of spaced apart nozzles each including an interior passage having a narrower width than length slit. Sources of air flow including at least one suction source are connected to spaces between the subnozzles to generate air flow around a lowest edge of the subnozzles between the subnozzles and spaces between the subnozzles wherein the interior passages of the subnozzles are isolated from the suction source.

19 Claims, 10 Drawing Sheets

ELECTRIC CLEANER EFFICIENT FOR CARPET AND ITS HEAD

FIELD OF THE INVENTION

The present invention relates generally to an electric cleaner, and particularly to an electric cleaner efficient for cleaning dust embedded in carpet.

BACKGROUND OF THE INVENTION

Various approaches to improve the efficiency of electric cleaners for removing dust embedded in carpet have been reported and also marketed. However, none of the approaches is satisfactory and their cleaning efficiency cannot exceed a certain limitation. In particular, they are very poor for cleaning long pile carpet.

The following discussion reviews known approaches and comments on the reasons for their low efficiency.

A simple approach involves a straight air suction head. The suction head includes a rectangular suction box having a long left to right, hereafter abbreviated as "L-R", dimension and a short fore to back, hereafter abbreviated as "F-B", dimension. The lower face of the suction head has a long L-R opening for sucking dust. The lowest ends of the front and back walls of the suction head contact a carpet surface and suction flows through the pile just under the walls removing dust in the flow path.

In this simple case, air flow path in the pile is located near the lowest ends of the walls in a short-circuited manner between the outer and inner air of the wall and cannot extend to the deep or bottom region of carpet pile. This is the reason for the low efficiency. Increased fan motor power can increase flow speed/volume in the short-circuit path, but cannot extend the path to deeper regions. Dust can be dislodged and removed from the pile at a flow speed over a certain threshold velocity: Vth. Too much of an increase in flow velocity over Vth is meaningless.

A second known approach to carpet cleaning incorporates mechanical agitation such as vibration or beating. However, cleaners including mechanical agitation are not currently on the market due to their noise. Mechanical agitation is basically ineffective, because such agitation cannot reach to deep/bottom regions of carpet. Additionally, the air flow to convey the dislodged dust cannot reach to the deep/bottom regions of the carpet.

A third widely used approach incorporates a rotating brush made of rubber or bristles, driven by a motor or an air turbine. It is expected that such agitation with the brush may be effective to dislodge dust in pile.

It is, in fact, fairly effective, but cannot extend beyond certain limitations. For example, such agitation also cannot reach to the deep/bottom regions. Furthermore, a powerful high-speed rotating brush very easily removes pile fibers from carpet. This defect is fatal for a high-grade, expensive carpet.

A fourth approach includes many slender finger-like pipes (hereafter referred to as "finger pipes") vertically arranged in a cleaning head. In such a device, pressurized fan-afterflow is fed to the top of the pipes. The pipes' flow blows out from the bottom end of the pipes to clean the pile.

Similarly, L-R extending slits are vertically arranged in the head and the blowing flow is directed to the surface of the carpet. The finger-pipe example, disclosed in Japanese Laid Open Pat. SHOU 50-155057 (Negishi), is shown in FIG. 14.

Examples of finger-pipes fed with room air (atmospheric pressure) are disclosed in Japanese Laid Open Pat. SHOU 63-122415 (Ariyoshi), HEI 1-256920 (Kadowaki). An example of small holes fed with room air is disclosed in Japanese Laid Open Utility Pat. SHOU 51-95266 (Nagasima). An example of a slit fed with room air is disclosed in Japanese Laid Open Utility Pat. SHOU 54-138467 (Urusibara).

In the above examples that include air either pressurized or room air directed to carpet, the bottom ends of the finger-pipes, the small holes, and the slit do not extend downward beneath the lowest ends of the head walls and only blow on the carpet surface.

These means that merely blow air toward the carpet surface are not effective, as the blowing air cannot penetrate into the deep regions of the pile due to the high flow resistance of pile.

The inventor of the present invention also disclosed a fifth approach in U.S. Pat. No. 5,647,092, including Pile Gorge Forming by means of mechanical contact with pile top. This gorge also has the effect of directing air flow reaching the bottom of the pile. However, its expected effect is decreased due to the following two reasons. The recirculated air jet, directed to the gorge, blows out the dust in the gorge bottom into suction air flow, but, unfortunately, also into the piles constituting both side walls of the gorge. An upflowing stream in the piles functioning to take out the dust is to be formed incorporating with the incoming flow through the piles just under the front and back walls. However, the flow resistance of pile is too high to form such an upstream.

A sixth approach to improve cleaning efficiency includes finger pipes extending downward into piles beneath the lowest ends of the walls at the cleaning head. An example of the sixth approach fed with pressurized air, as shown in FIGS. 15A and 15B, is disclosed in U.S. Pat. No. 3,268,942 to Rossnan. Another example fed with room air, as shown in FIGS. 17A and 17B, is disclosed in U.S. Pat. No. 4,594,749 to Waterman. A finger pipe array used solely for sucking air in piles, as shown in FIGS. 16A and 16B, is disclosed in U.S. Pat. No. 3,611,473 to Johnson.

This sixth approach can be expected to overcome the limitation that other known approaches discussed above cannot generate air flow to reach to the deep/bottom region of the carpet, because the tip or lowest end of the finger pipe can enter deep into the carpet.

However, this sixth approach is still insufficient. The fault is due to the finger pipe shape. The air just blowing out from the tip or lowest end of the finger pipe may have sufficient speed to dislodge the dues in the pile. However, the air speed decreases rapidly below the threshold Vth, as the air flows away from the tip in a two dimensional manner near the tip and then immediately diffuses upward in a three-dimensional manner. As a result, cleanable area is very localized to a region (δ in diameter) near the tip. Additionally, too greatly decreased flow speed cannot convey the dislodged dust through pile.

Furthermore, during the cleaning head stroke (stroke speed: Vst), an exposed time (Tex) of specific pile fiber to a speed flow higher than Vth ($Tex=\delta/Vst$) is too short to dislodge any dust in the pile. Such exposed time Tex has to be longer than a certain threshold value Tth.

A seventh approach to improve cleaning efficiency is disclosed by Takemura (Japanese Laid Open Pat. SHOU 54-158066, and SHOU 55-153). Takemura discloses a head that has plural downwardly opening slits partly provided, as shown in FIGS. 18 B-1 and B-2, on a front wall lower face and fed with room air from openings provided in the foreside of the front wall, as shown in FIG. 18A.

At first glance, these slits may lead air flow into piles. However, the lower face of the front wall is flat, as shown in FIG. 18A, so the lower face cannot sink deep into piles. Takemura is only aiming to distribute suction power, P, more uniformly along an L-R direction as illustrated by curve "a" than the conventional distribution illustrated by curve "b", as shown in FIG. 18C.

SUMMARY OF THE INVENTION

The basic concept of the present invention is to generate direct air flow to reach the deep/bottom region of carpet and keep its blow speed in the pile over Vth over a period of time Tth. Hereafter, this concept is called "DARB".

Inventions utilizing the DARB concept are discussed below in greater detail.

One embodiment of the present invention employs subnozzles 1 and/or slits 13. Through the subnozzles and/or slits, blowing flow from pressurized or room air directed into the deep/bottom region of carpet, or sucking flow directly from deep/bottom pile can be provided, without obstruction of the pile flow resistance as shown in FIGS. 1A, 8A and 8B.

The subnozzles are arrayed in a bank. Each subnozzle includes a hollow rectangular pipe having a horizontal cross sectional shape having a narrow L-R dimension and a long F-B dimension. The front end and back end of the pipe are sharpened like a ship's bow and stern so as to decrease stroke resistance due to the pile, as shown in FIGS. 1B and 1C.

The slit has a long L-R dimension and is provided at the peak of the cross section of a front/back wall having an inverted mountain-like cross section, so as to locate it at the deepest part of the front wall in the pile, as shown in FIGS. 8A and 8B. The inverted mountain shape cross section allows the bottom ends of the wall to sink into carpet pile.

Preferably, subnozzles 1 are utilized for blowing air 3 and spacing intervals 2 of the subnozzles are utilized for suction flow 5 and generating turning flow 4 in the deep/bottom region of the carpet piles.

The blowing flow, turning flow, and suction flow have almost the same cross sectional flow area. Namely, diffusion is one dimensional. Therefore, high flow velocity is maintained in the pile along the F-B length of the subnozzles. The F-B length assures enough exposed time Tex over threshold time period Tth during the cleaning head stroke.

Dust larger than the nozzle width is arranged to be cleaned through the L-R long suction room 12 provided just in front or back of the subnozzle bank, as shown in FIGS. 3D and 3E. Dust much larger than the L-R long suction room 12 is arranged to be cleaned through a suction pipe prestage room 18, as shown in FIG. 4.

The front and/or back walls of the subnozzles is/are formed to have an inverted mountain-like cross sectional shape, so that their peak ridges can easily sink as deep as possible into carpet pile. The slit(s) 13 is/are provided at the peak ridge so that the air flow can reach directly to deeper/near-bottom regions of the carpet pile as shown in FIGS. 8A, 8B, 2B, 10, and 11.

These slits also play a role of conventional by-pass flow openings. By-pass flow opening is usually provided at the extreme of both left and right ends of a head to reduce stronger suction to the pile and the attendant too high stroke resistance. The conventional by-pass flow is a waste of fan power. However, according to the present invention, a part of the power for the conventional by-pass flow is utilized not only for stroke resistance reduction but also for enhancing the cleaning efficiency.

An additional slit can also be provided inside a head, as shown in FIG. 8B.

The front and/or back wall can include the subnozzle bank. FIGS. 6A and 6B shows an example where a back wall is replaced with a subnozzle bank.

Insertion of subnozzle tip or slit into deep/bottom region of carpet pile causes high flow resistance due to longer path length in the pile. Plural fan operation in serial or in parallel can solve this problem.

The means of pile gorge forming, a modified version of U.S. Pat. No. 5,647,802, can be another means for carrying out the DARB concept, as the sucking or blowing flow can reach to the bottom of the gorge directly.

According to the present invention, it is preferable that the head is arranged so that the flow in the gorge is suction flow, as described below. According to this embodiment, air is sucked through the pile under the front/back walls of the suction head, reaches to the gorge, and is sucked further into L-R long suction room over the pile. The velocity of the leaving flow from the gorge should be high enough to convey the dislodged dust. Conventional mechanical contact means for gorge forming is so large that the suction room enclosing the contact means has too large a cross section to keep the flow velocity high enough.

In order to decrease the cross section, the present invention may include a cylinder shown in FIGS. 2A, 2B and 10, or a belt, shown in FIG. 11, as the contacter. Most of the cylinder extends out of the head or into its ceiling.

The present invention may also include openings in the lowest part of the left and/or right side wall(s) of the head located at a corresponding position to the gorge. Such openings provide sufficient high speed flow along the gorge in L-R direction to remove dust in the bottom of the gorge.

A gorge forming means also incorporating pressurized air such as recirculated flow is also disclosed in FIG. 2B.

Jet 3 is directed to the shoulder of the gorge instead of the gorge bottom as in the prior art shown in FIG. 2C. The penetrated jet flow into the pile turns fore and back. The fore flow also reaches into the gorge 10. The fore flow, together with the flow 14 from the slit 13 forms the up-stream. The flows 4 and 14 dislodge dust in pile and convey the dust away.

BRIEF DESCRIPTION OF THE FIGURES

These and other more detailed and specific objects and features of the present invention will be more fully disclosed in the following, in which:

FIG. 18C shows the effect of the slits to flatten the suction power distribution along a left-right direction.

DETAILED DESCRIPTION OF THE PREFERRED EMBODIMENTS

Some embodiments of the present invention utilize subnozzles as a duct for direct air flow reach towards or from the bottom region of carpet pile. Other embodiments of the present invention utilize slits instead of or together with the subnozzles.

Additional embodiments of the present invention utilize the pile gorge as the duct for direct suction flow from the bottom of the gorge.

The following describes preferred embodiments of the present invention.

Figure 1A:
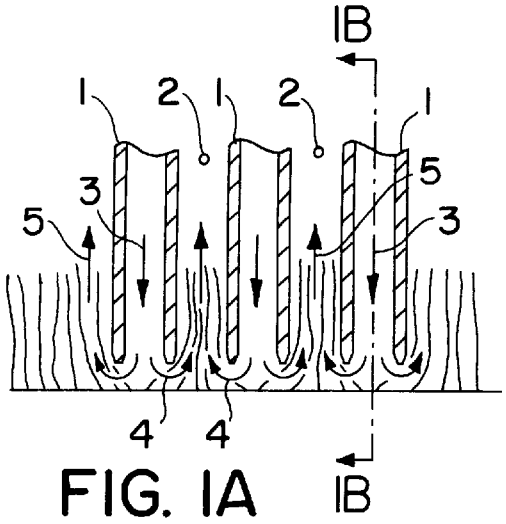
FIG. 1A is a left-right cross-sectional view of sub nozzles showing the principle of the DARB concept according to the present invention.

FIGS. 3A–3E show a first embodiment; its operating principle is shown in FIG. 1A. In FIGS. 1A–1C and 3A–3E, elements 1 are subnozzles and elements 2 are their spacing intervals. Usually, the width of spacing intervals 2 is chosen several times wider than the width of subnozzles 1. Also in these figures, arrows 3 represent blowing flow, arrows 5 represent suction flow and arrows 4 represent turning flow. The lowest ends or tips of the subnozzles are inserted into deep/bottom region of pile. The turning flow 4 and sucked flow 5 created by the subnozzles in the carpet pile have nearly same high speed as the blowing flow 3, since the flow from 3 to 5 is almost one dimensional due to the longer front-to-back length of subnozzles in comparison with the left-to-right width. Therefore, the flow 4 and 5 successfully remove dust embedded in pile.

Figure 1B:
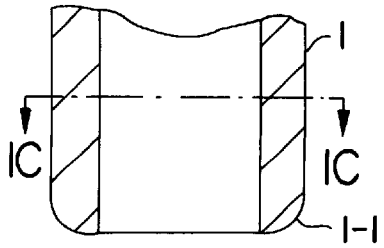
FIG. 1B is a front-back cross-sectional view of the subnozzle.
Figure 1C:
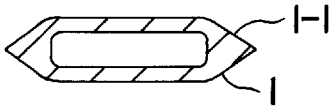
FIG. 1C is a top cross-sectional view of the subnozzle shown in FIG. 1B showing a ship-like shape.
Figure 2A:
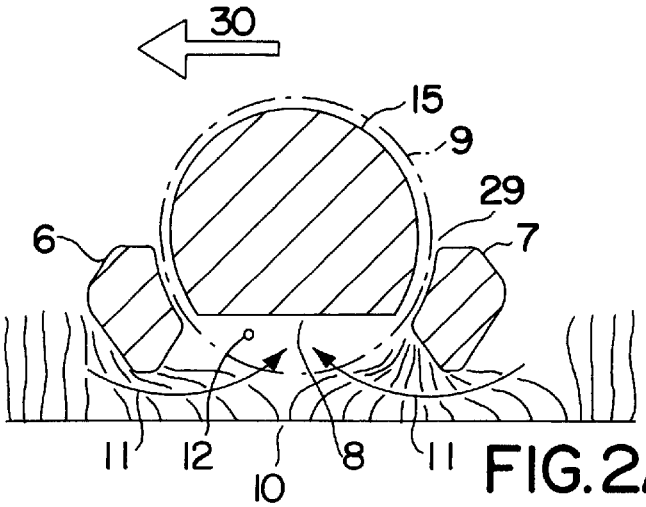
FIG. 2A is a front-back cross-sectional view of a suction-type gorge forming cleaner head showing the DARB conceptual principle according to the present invention.
Figure 2C:
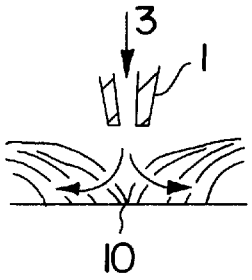
FIG. 2C PRIOR ART
FIG. 2C is a cross-sectional view of a prior art nozzle design in the process of being utilized to clean carpet.
Figure 2B:
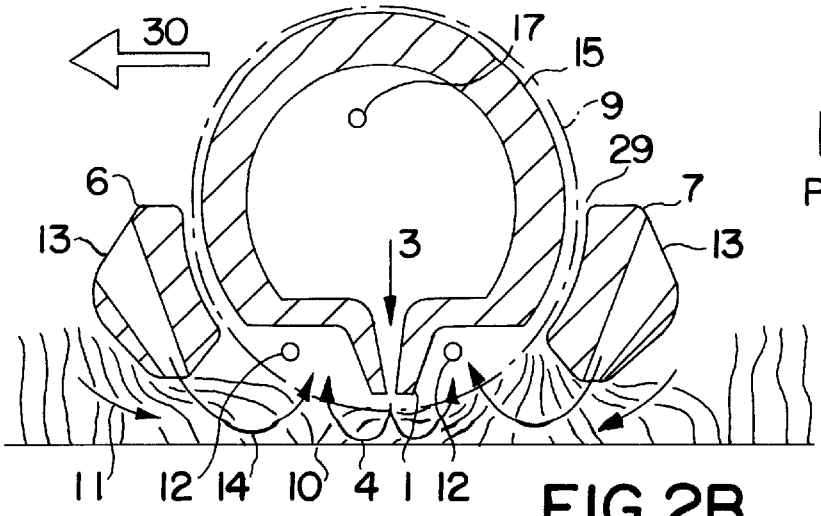
FIG. 2B is a front-back cross-sectional view of a suction or pressurized-air gorge forming cleaner head showing the DARB conceptual principle according to the present invention.
Figure 3A:
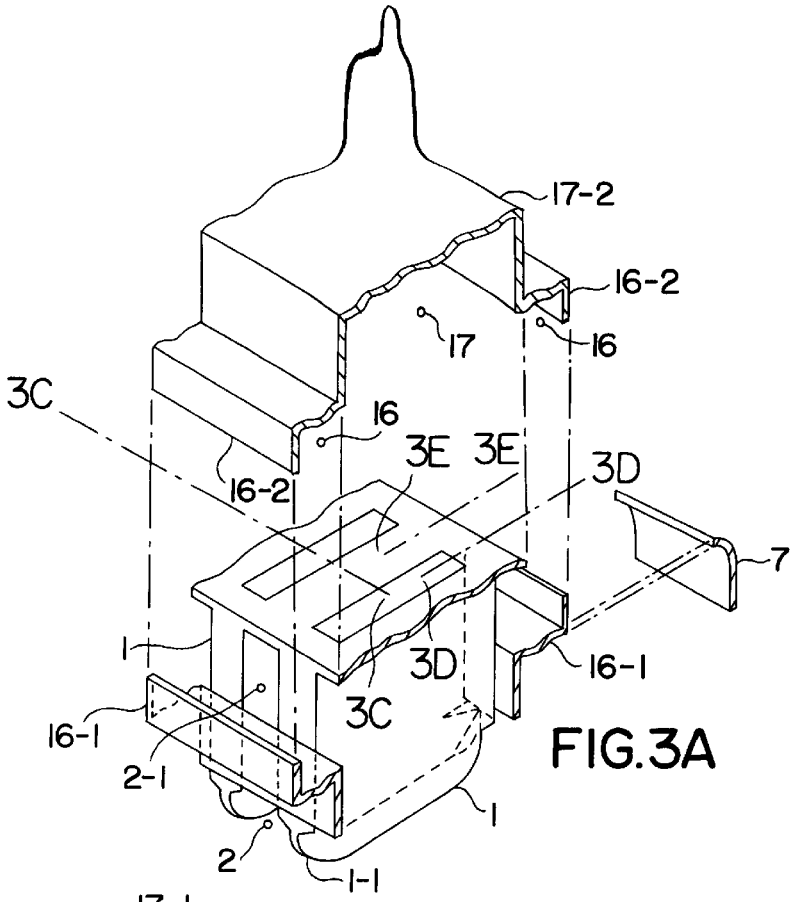
FIG. 3A is a perspective exploded view of a portion of recirculating flow head according to one embodiment of the present invention.
Figure 3B:
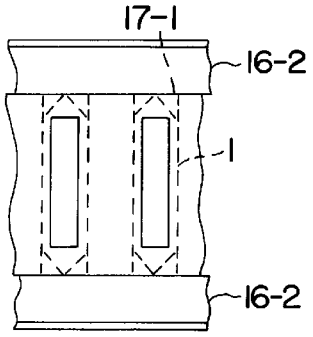
FIG. 3B is a top view of the embodiment shown in FIG. 3A.
Figure 3C:
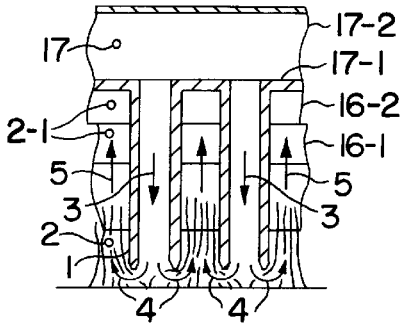
FIGS. 3C, 3D and 3E are various cross-sectional view of the embodiment shown in FIG. 3A.
Figure 3D:
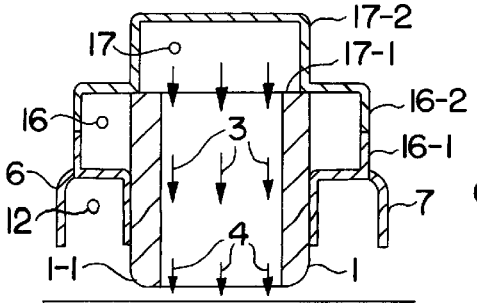
Figure 3E:
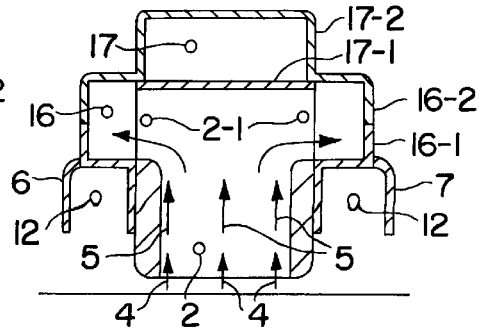
Figure 4:
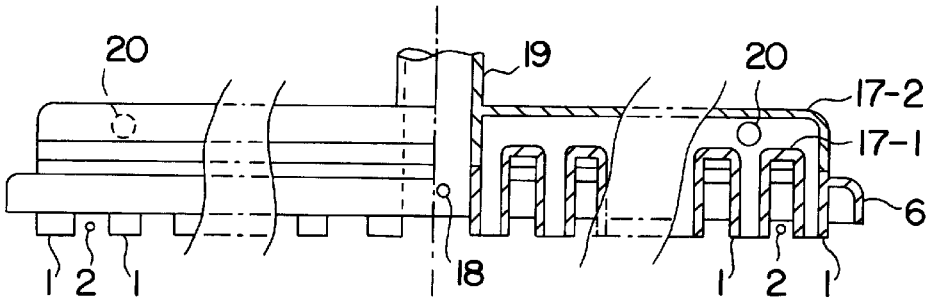
FIG. 4 is a partial left-right cross-sectional front view of a head of the embodiment shown in FIG. 3A.

Each subnozzle has the shape shown in FIGS. 1B and 1C. The front width of the subnozzles is narrow and the front and back ends are sharpened like a ship bow and stern in order to lessen stroke resistance as shown in FIGS. 1B and 1C. For carpet without a loop pile structure, a nose can be provided on the outer lowest portion of each of the front and back ends. The nose helps the subnozzles to sink into carpet pile.

If the stroke resistance is still high, a power assisted or power driven stroke will be included.

FIGS. 3A–3E and 4 show an actual embodiment of a suction head including subnozzles according to the present invention. The suction head shown in FIGS. 3A–3E and 4 includes a pressurized room 17 prestage to the subnozzles. The pressurized room 17 is elongated in a left-right direction and is connected to the after-flow of a suction fan or a separately provided pressure fan. The suction interval 2 shown in FIGS. 3A–3E and 4 also conducts to a suction room 16 post to the subnozzles. The suction room 16 is elongated in a left-right direction. The sucked flow from the interval 2 moves to suction room 16 through passages 2-1. Another left-right elongated and lower-face-open suction room 12 is provided for dust larger than the interval width. The flows of both suction rooms 16 and 12 jointly lead to a suction-pipe prestage room 18, and then into suction pipe 19. The suction-pipe prestage room 18 also serves as a suction port for dust much larger than room 12.

Figure 5A:
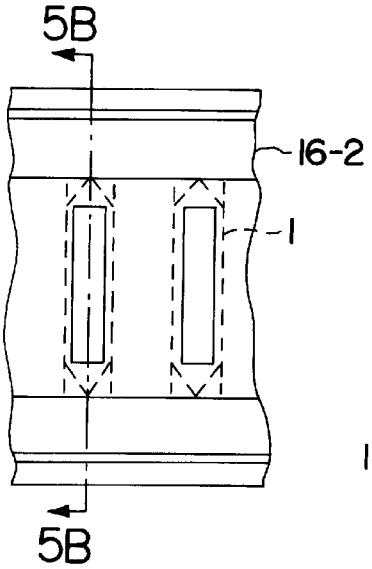
FIG. 5A is a top view of a portion of a suction head, the subnozzles of which are fed with room air, according to another embodiment of the present invention.
Figure 5B:
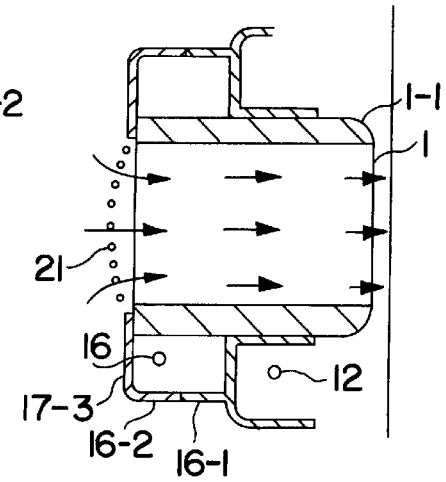
FIG. 5B is a cross-sectional view of a head of the embodiment shown in FIG. 5A.

FIGS. 5A and 5B show another embodiment of the present invention. According to the embodiment shown in FIGS. 5A and 5B, subnozzles are fed with room air through the filter 21. Other aspects of the embodiment shown in FIGS. 5A and 5B are quite similar to the embodiment shown in FIGS. 3A–E and 4.

Figure 6A:
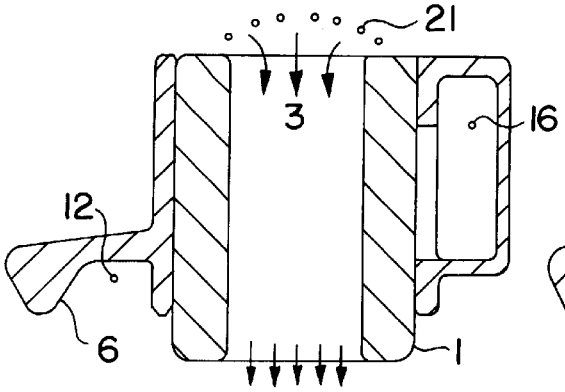
FIG. 6A is a cross-sectional view of a subnozzle provided at the back wall of a head of a further embodiment according to the present invention.
Figure 6B:
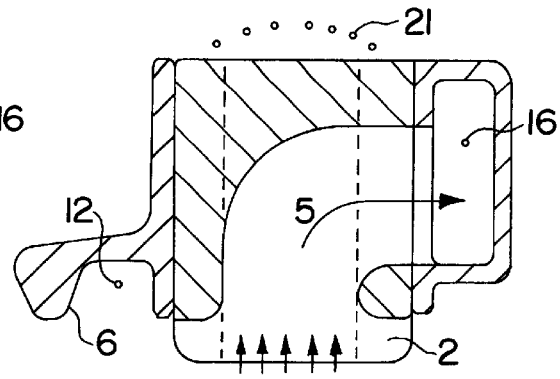
FIG. 6B is a cross-sectional view of an interval between the subnozzles of the embodiment shown in FIG. 6A.

FIGS. 6A and 6B show another embodiment of the present invention that includes a bank of subnozzles in place of the back wall of a head. This is simpler than the embodiments shown in FIGS. 3A–3E, 4, 5A, and 5B. In the embodiment shown in FIGS. 6A and 6B the bank of subnozzles can slide upward or downward so as to adapt to various lengths of pile. The bank can sink into pile under its own weight and suction force. Of course, this construction of up-down slidable subnozzle bank can also be applied to the embodiments shown in FIGS. 3A–3E, 5A and 5B.

Figure 7A:
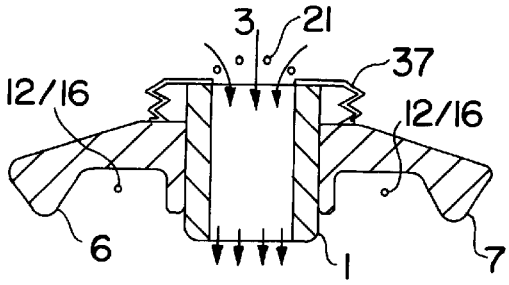
FIG. 7A is a cross-sectional view of a subnozzle provided in the mid front-back space of a head and pushed down by springs according to a still further embodiment of the present invention.
Figure 7B:
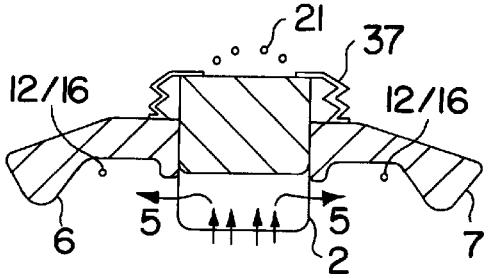
FIG. 7B is a cross-sectional view of a suction interval between the subnozzles of the embodiment shown in FIG. 7A.

FIGS. 7A and 7B show a fourth embodiment of the present invention, where a bank of subnozzles is provided in the middle of a head and can also slide up/down. A flexible bellows-like member 37 is provided to seal the gap of the sliding surface and also to force the bank to sink into the pile. The bank can be motor-controlled to sink into appropriate depth. In this embodiment the rooms 12 and 16 are joined into one room 12/16, simplifying the design.

For cleaning a flat floor, it is desirable for the subnozzle bank to be pulled up manually or automatically with a motor so as not to contact or damage the floor.

Figure 8A:
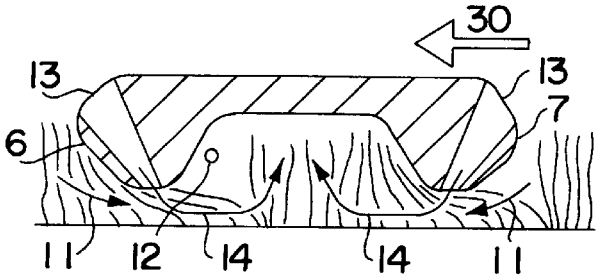
FIG. 8A is a cross-sectional view of a suction head, both walls of which have slits, according to yet another embodiment of the present invention.

FIG. 8A illustrates a fifth embodiment of the present invention. Slits directly introducing room air into the pile are provided in both front and back walls at the lowest peak ridge of inverted-mountain-like cross-section. The room air can enter deep near the pile bottom without any flow resistance, which otherwise would be encountered as shown by the flow path 11, and can penetrate through the pile as illustrated by the effective flow 14. The experiments for a single slit only in the front wall provided almost the same cleaning efficiency as a conventional rotating brush cleaner for carpet-embedded dust and almost twice the efficiency for dust in a narrow deep groove. The flow in slit is an alternative of the conventional by-pass flow usually provided through the opening at both left and right ends of a simple suction type head and lessens stroke resistance without losing fan power in vain due to by-passing.

Figure 8B:
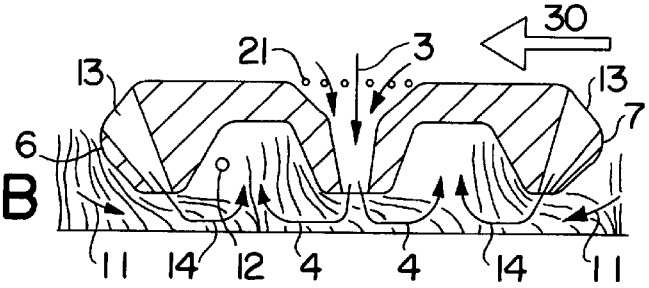
FIG. 8B is a cross-sectional view of a suction head that has slits in both walls and also in the center according to a further additional embodiment of the present invention.

Another central slit can be provided as shown in FIG. 8B.

Any head of this invention utilizing only room air can be used as an alternative to a conventional cleaning head.

Figure 9A:
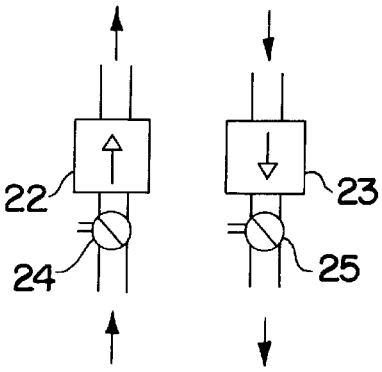
FIGS. 9A, 9B and 9C are schematic diagrams of plural fan/motor combinations according to the embodiment of the present invention.
Figure 9B:
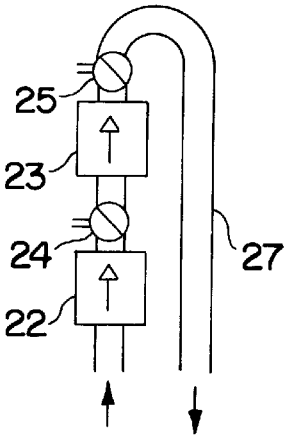
Figure 9C:
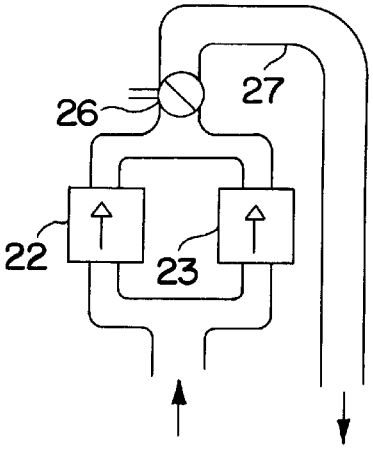

FIGS. 9A–9C illustrates a sixth embodiment of the present invention. The embodiment shown in FIGS. 9A–9C includes combined operation of plural fan/motors 22 and 23. The embodiment depicted in FIGS. 9A–9C, includes flow control valves 24, 25, and 26.

High flow resistance caused by deep insertion of the subnozzle tips near the carpet pile can be solved by serial operation of the fan/motors and control valves, as shown in FIG. 9B. The serial operation shown in FIG. 9B can provide a higher flow rate for a certain flow resistance than the parallel operation shown in FIG. 9C.

The modified arrangement shown in FIG. 9A, where the fan/motor 23 is inversed, is effective to optimally control the suction flow 16 of the subnozzle bank and the flow of suction room 12 in FIGS. 3A–3E, 4, 5A and 5B in a mutually independent manner.

The arrangement shown in FIG. 9A is effective for the cleaner of the present invention utilizing both pressurized air to blow and vacuum to suck from room air. Each blowing flow and suction flow can be provided and controlled by independent fan/motors respectively to optimize each condition.

Figure 10:
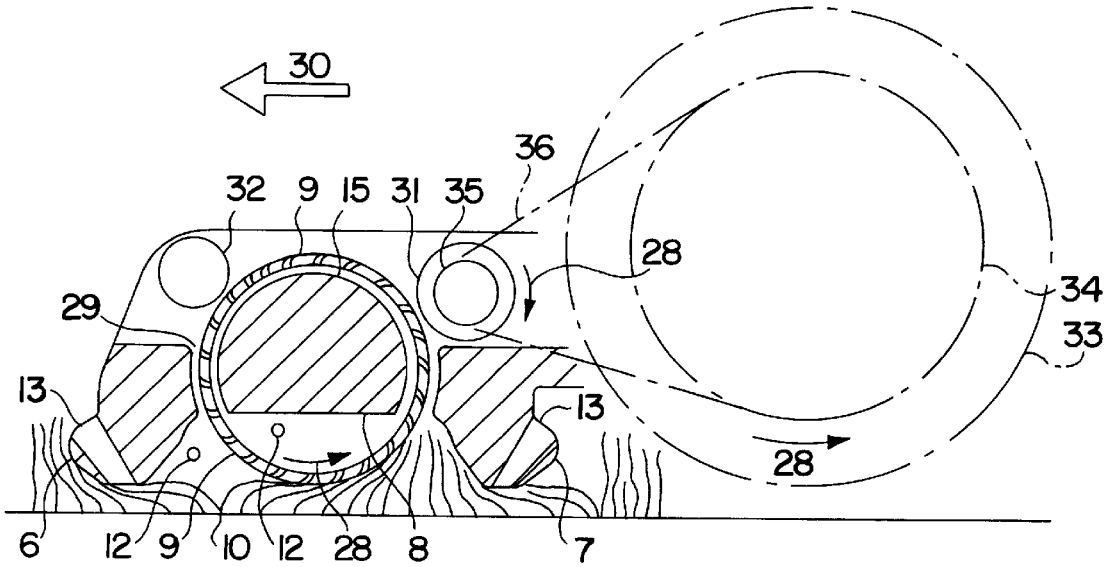
FIG. 10 is a cross-sectional view of a suction head that has a pile gorge forming rigid cylinder according to another embodiment of the present invention.

FIG. 10 illustrates a seventh embodiment of the present invention. The embodiment shown in FIG. 10 includes a rotating cylinder 9 penetrating the ceiling 8 of the cleaning head. The lower surface of the cylinder 9 contacts the pile. The pile is bent forward by contact with front wall 6 during the stroke direction 30. The pile is inversely bent backward by the contact with cylinder 9. Thus, a gorge 10 is formed. Suction rooms 12 and their cross-sectional area are reduced by extending the cylinder beyond the head ceiling in comparison with the designs shown in FIGS. 12A–12C and 13A–13D. Higher flow speed can thereby be obtained. The cylinder can be of hollow mesh, allowing air flow through the surface. Alternatively the cylinder can have a solid surface not allowing the air flow through the surface. In the latter case, the cross-section of the suction room becomes much smaller. Driving wheel 31 turns the cylinder 9 in direction 28 and is belt-coupled via wheel 35, belt 36 and wheel 34 to a stroke wheel 33 so as to change its driving direction according to the stroke direction. Idle roller 32 supports the cylinder in position. The slits 13 in front wall 6 and back wall 7 serve the same function as the slits in the embodiment shown in FIGS. 8A and 8B. The air leaking through the gap 29 at the cylinder-penetrating part of the ceiling can prevent the gap 29 from being clogged with dust dislodged in the head.

An eighth embodiment of the present invention may also be explained by referring to FIG. 10. According to the eighth embodiment, the openings (not shown) to admit air toward the gorge 10 can be provided on the bottom of both side walls of the head at locations corresponding to the gorge F-B position. Thus, air admitted by openings in the side walls sweeps out bottom-dust in L-R direction, with minimum dust-blow-out into gorge shoulders.

Figure 11:
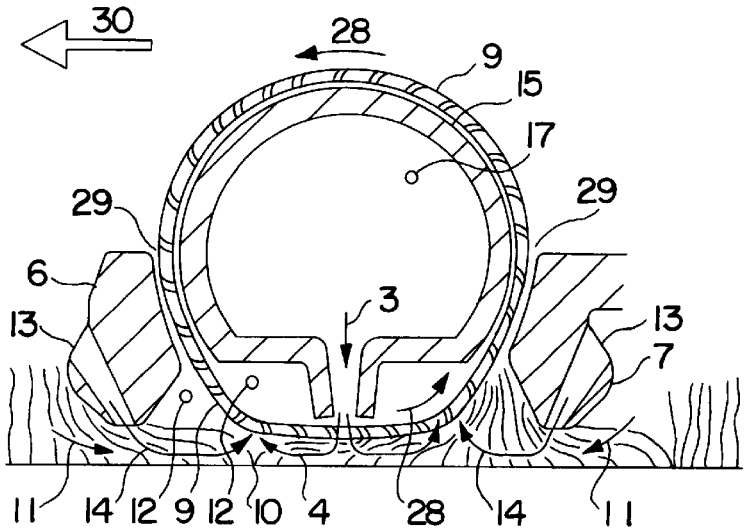
FIG. 11 is a cross-sectional view of a recirculating flow head that has a pile gorge forming elastic cylinder according to yet another embodiment of the present invention.
Figure 12A:
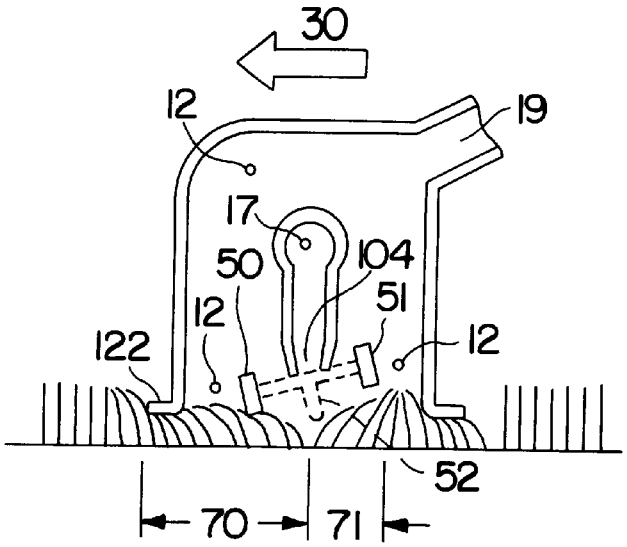
FIG.12A PRIOR ART
FIGS. 12A, 12B, 12C and 13A, 13B, 13C show cross-sectional views of prior art recirculating flow heads, which have pile gorge forming means.
Figure 12B:
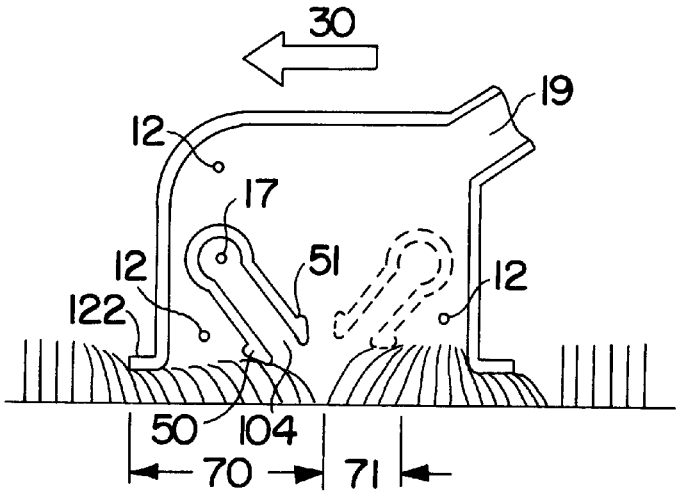
FIG.12B PRIOR ART
Figure 12C:
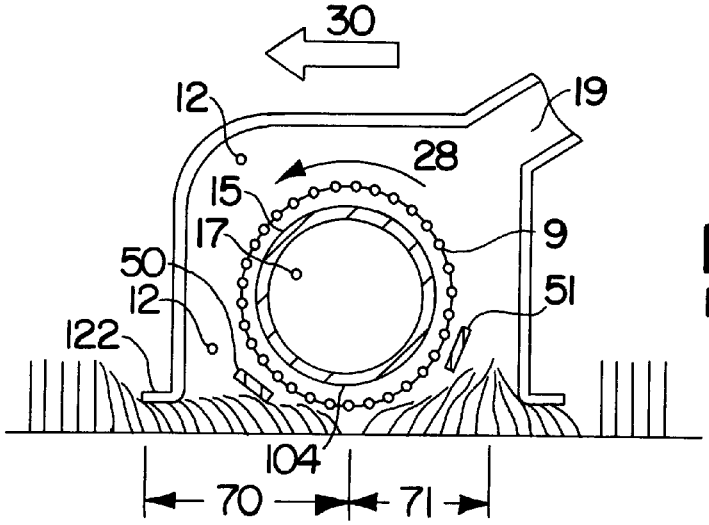
FIG.12C PRIOR ART
Figure 13A:
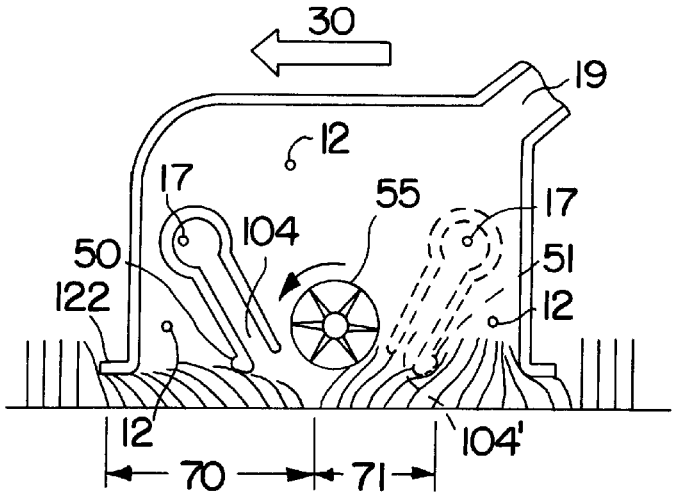
FIG.13A PRIOR ART
Figure 13B:
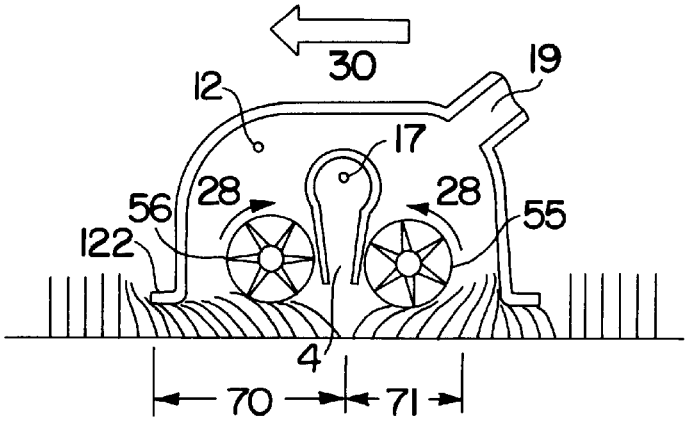
FIG.13B PRIOR ART
Figure 13C:
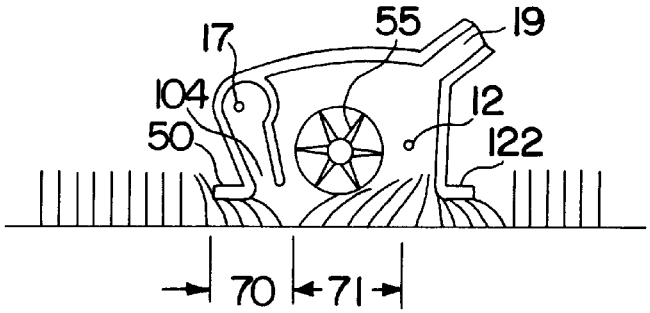
FIG.13C PRIOR ART
Figure 13D:
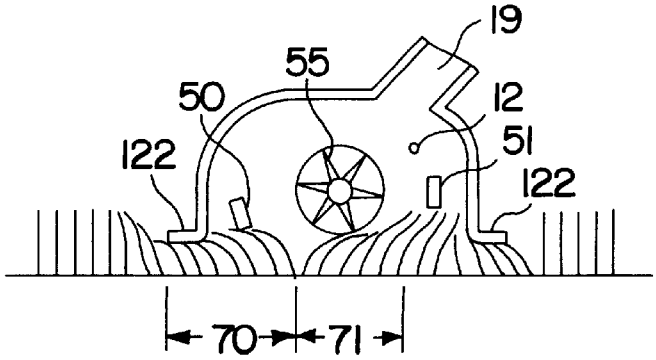
FIG.13D PRIOR ART
FIG. 13D shows a cross-sectional view of a prior art suction head, which has a pile gorge forming means.
Figure 14:
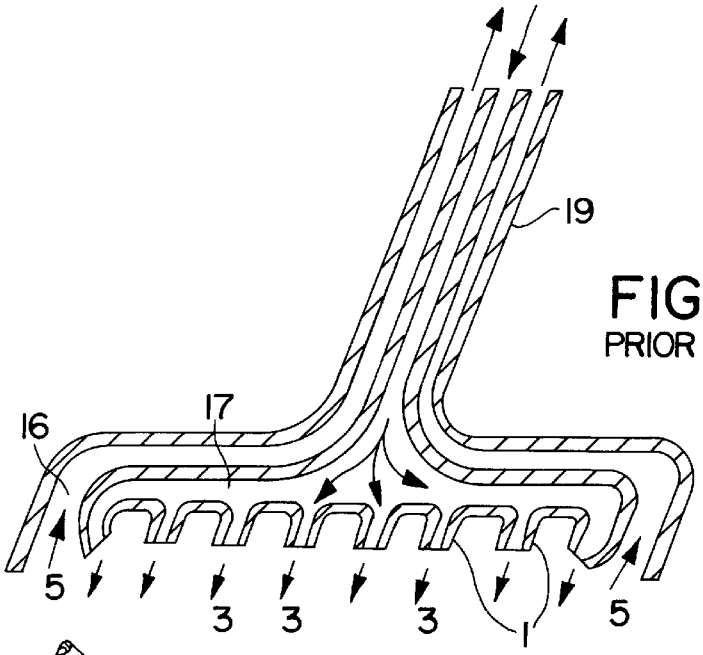
FIG.14 PRIOR ART
FIG. 14 shows a cross-sectional view of a prior art recirculating flow head, which has an array of finger pipes within the lowest wall level of a head.
Figure 15A:
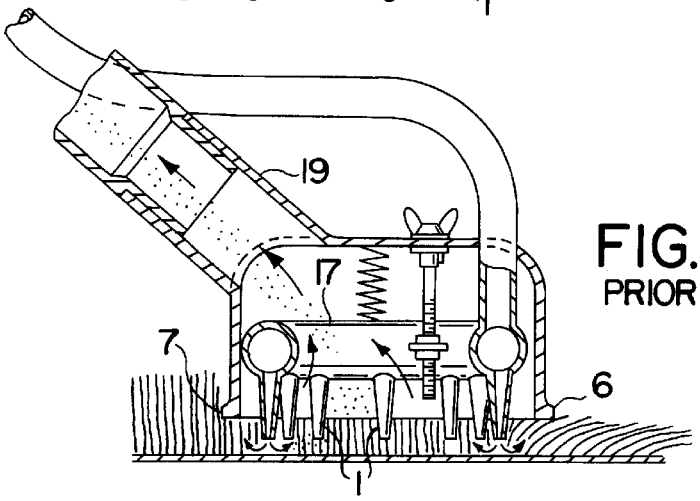
FIG.15A PRIOR ART
FIGS. 15A and 15B show cross-sectional views of a prior art recirculating flow head that has an array of finger pipes extending beneath the lowest wall level.
Figure 15B:
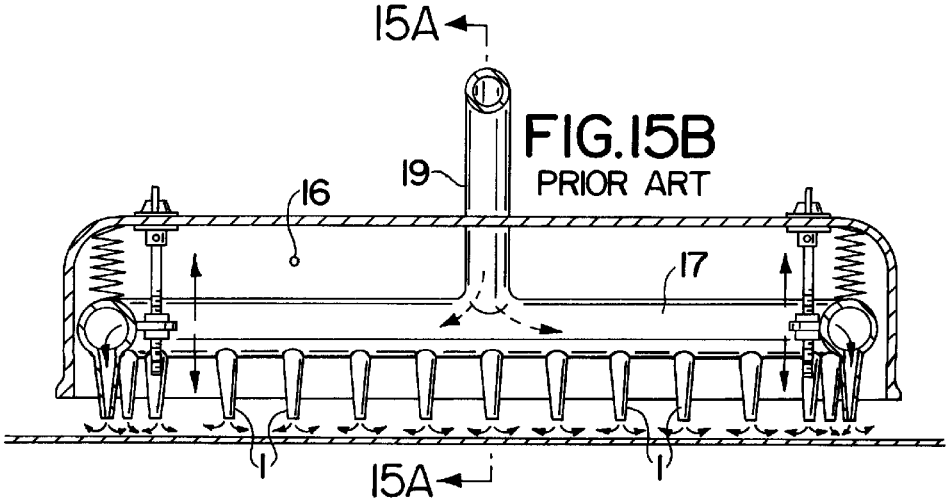
FIG.15B PRIOR ART
Figure 16A:
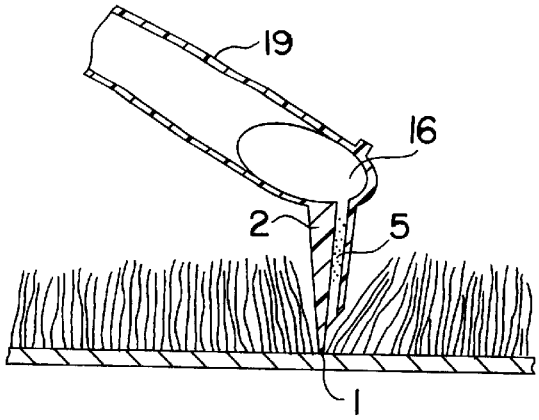
FIG. 16A PRIOR ART
FIGS. 16A and 16B show, respectively, a front and a sectional view of a prior art flow head that is constructed with only an array of fmger nozzles.
Figure 16B:
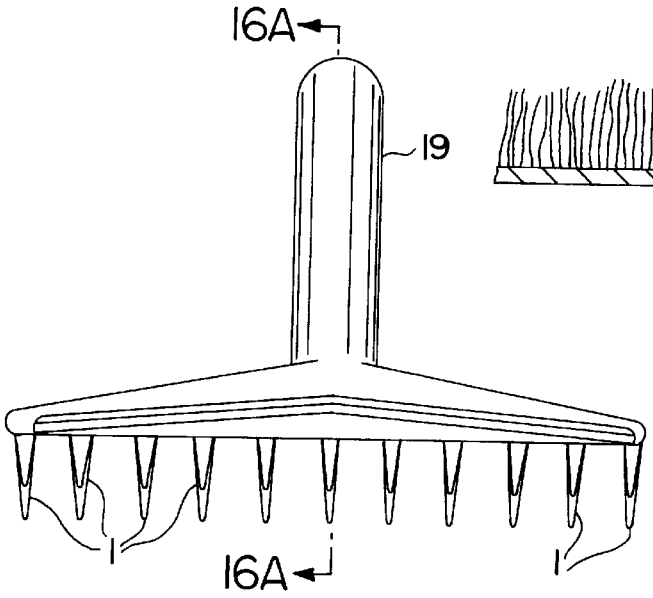
FIG. 16B PRIOR ART
Figure 17A:
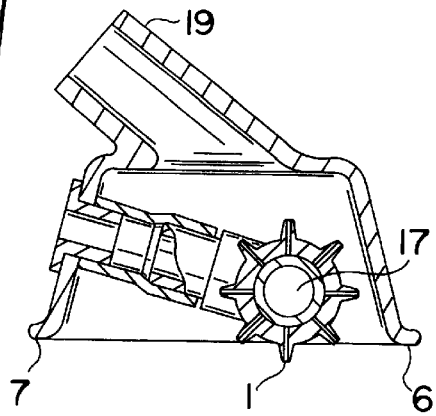
FIG. 17A PRIOR ART
FIGS. 17A and 17B show, respectively, a partial cut-away front view and a cross-sectional view of a prior art head that has plural banks of finger pipes around a rotating cylinder, only the lowest bank is selected, extends beneath the lowest wall level, and is fed with room air.
Figure 17B:
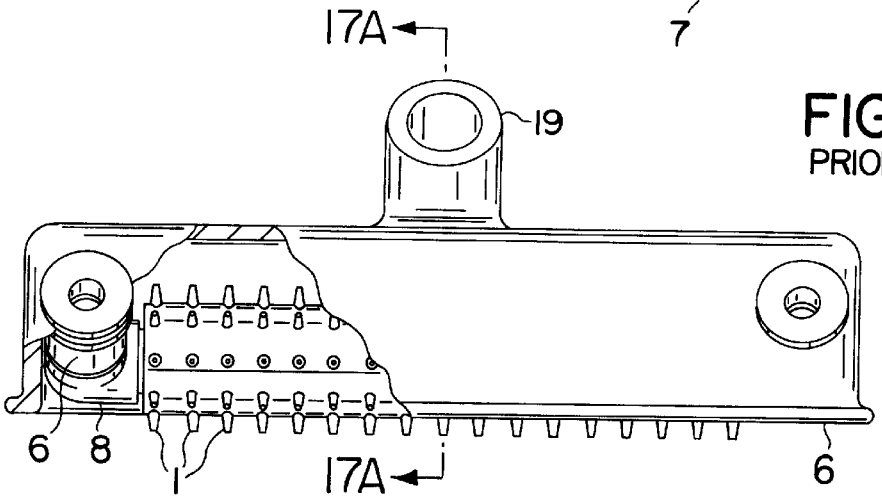
FIG. 17B PRIOR ART
Figure 18A:
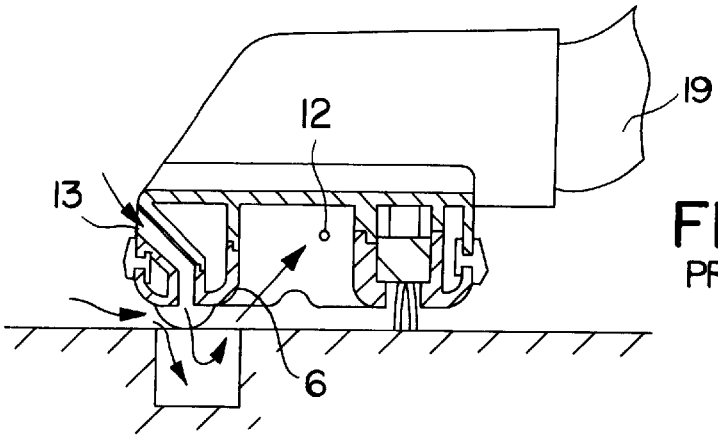
FIG. 18A PRIOR ART
FIGS. 18A, 18B-1, 18B-2, and 18C show a prior art head, which has plural slits in the flat lowest face of the front wall, as shown in the bottom views FIGS. 18B-1 and 18B-2, and wherein their slits are fed with room air, as shown in cross-sectional view FIG. 18A.
Figures 1, 18B:
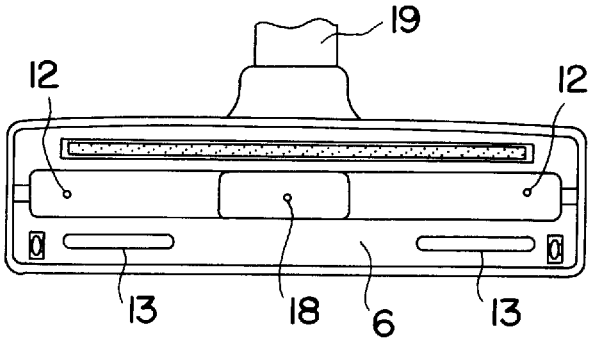
FIG. 18B-1 PRIOR ART
Figures 2, 18B:
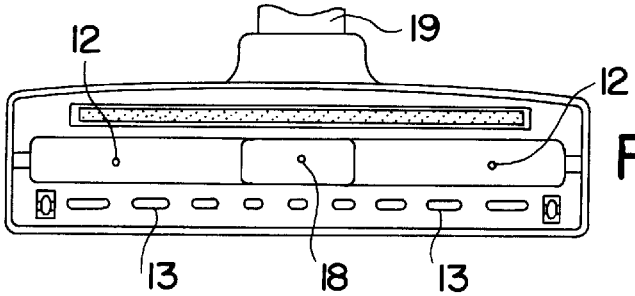
FIG. 18B-2 PRIOR ART
Figure 18C:
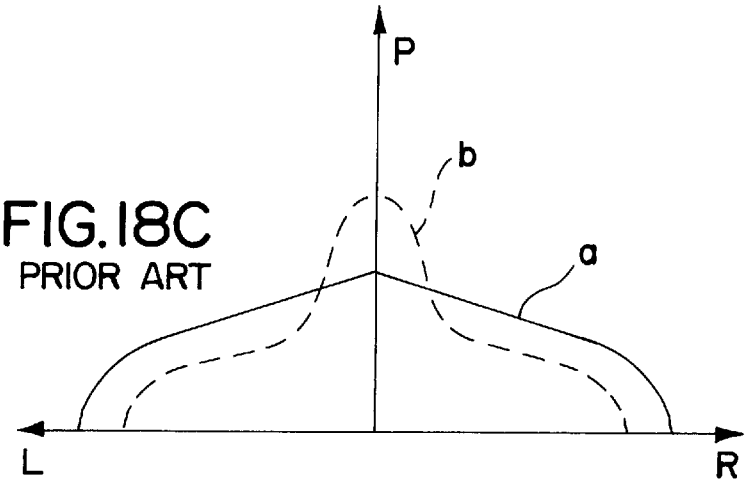
FIG. 18C PRIOR ART

FIG. 11 illustrates a ninth embodiment of the present invention. In the embodiment shown in FIG. 11, pressurized room 17 is provided to feed a jet stream 3 through the mesh surface of the cylinder 9 into pile. The jet is directed to the shoulder of the gorge and penetrates into pile to form a flow 4. The flow 4 meets the flow 14 from the slit 13 at the gorge 10 and goes up into suction room 12 through the open gorge. The cylinder 9 is made elastic and deforms as shown in FIG. 11, for enhancing better contact with carpet pile.

Others of the ninth embodiment are quite similar to the embodiment shown in FIG. 10.

Additional variations to the present invention may include introducing agents for flavoring, static charge eliminating, cleaning, sterilizing, anti-fungus processing, etc. in the flow path of room air or pressurized air into the pile.

Advantages of the present invention include realization of high cleaning efficiency even for long piled carpet; eliminating rotating brushes, agitating beaters, etc.; silent operation; no damage to precious carpet; simple design; light weight; washable; usable for both carpet and flat floors; and usable for both dry dust and liquids.

What is claimed is:

1. A electric suction cleaner including a cleaning head, the cleaning head, comprising:

a bank of a plurality of subnozzles having a front, a back, a right and a left, the subnozzles being spaced apart along a length of the bank in the right-left direction such that a gap exists between adjacent subnozzles, each subnozzle being elongated in the front-back direction perpendicular to the right-left direction and narrow in the right left-direction, each subnozzle being hollow from a top to a bottom thereof so as to define interior chambers therein, the construction being arranged such that a flow of air may be directed through each of the subnozzles from the top to the bottom thereof, each of the subnozzles having a front end and a back end that each taper to facilitate movement of the cleaning head through a pile of a carpet; and a suction chamber having a front, a back, a right and a left and being elongated in the right-left direction along the length of the bank of subnozzles and arranged along one of the front and back of the bank of subnozzles, wherein air flows from the gaps between the subnozzles to the suction chamber;

wherein air flows from above and through the bank of subnozzles from the top to the bottom thereof, turns and changes direction toward the gaps between adjacent subnozzles and is subsequently directed to the suction chamber.

2. The electric cleaner according to claim 1, wherein air flowing into the bank of subnozzles is room air.

3. The electric cleaner according to claim 1, wherein air flowing into the bank of subnozzles is pressurized air.

4. The electric cleaner according to claim 1, wherein each subnozzle has a planar lower surface.

5. The electric cleaner according to claim 4, wherein the planar lower surface of each subnozzle is parallel to carpet being cleaned by the cleaner.

6. The electric cleaner according to claim 1, wherein the front and back ends of the each of the subnozzles taper to a point.

7. The electric cleaner according to claim 1, wherein each of the subnozzles has a lower end that tapers in the right-left direction and in the front-back direction.

8. The electric cleaner according to claim 1, wherein a position of the bank of subnozzles is vertically alterable with respect to the cleaning head.

9. The electric-cleaner according to claim 8, wherein the vertical position of the bank of subnozzles is automatically adjusted according to pile height of carpet being cleaned by the cleaner.

10. The electric cleaner according to claim 1, wherein the bank of subnozzles can be fixed in a desired vertical position.

11. The electric cleaner according to claim 1, wherein a lower surface of the subnozzles can extend further down toward a surface being cleaned than all other portions of the cleaner.

12. The electric cleaner according to claim 1, wherein the suction chamber comprises at least one additional suction chamber positioned in front of or behind the bank of subnozzles for receiving larger dust than gaps between the subnozzles.

13. The electric cleaner according to claim 1, further comprising:

a suction pipe prestage room formed by an increased gap between the subnozzles in the vicinity of a central section of the bank of subnozzles for receiving large dust.

14. The electric cleaner according to claim 1, further comprising:

at least one fan and at least one motor for supplying air to the bank of subnozzles.

15. The electric cleaner according to claim 1, further comprising:

a plurality of fans and a plurality of motors for supplying air to the bank of subnozzles.

16. The electric cleaner according to claim 15, wherein the plurality of fans are arranged in parallel.

17. The electric cleaner according to claim 15, wherein the plurality of fans are arranged serially.

18. The electric cleaner according to claim 15, wherein the plurality of fans operate independently.

19. The electric cleaner according to claim 1, further comprising a plurality of slits arranged in front of or behind the bank of subnozzles.

* * * * *